US010921046B2

(12) United States Patent
Mills et al.

(10) Patent No.: US 10,921,046 B2
(45) Date of Patent: Feb. 16, 2021

(54) METHOD FOR DEFROSTING AN EVAPORATOR OF A SEALED SYSTEM

(71) Applicant: Haier US Appliance Solutions, Inc., Wilmington, DE (US)

(72) Inventors: Robert T. Mills, Louisville, KY (US); Joshua Duane Longenecker, Louisville, KY (US); Alan George Constance, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 194 days.

(21) Appl. No.: 16/139,172

(22) Filed: Sep. 24, 2018

(65) Prior Publication Data

US 2020/0096248 A1 Mar. 26, 2020

(51) Int. Cl.
*F25D 21/00* (2006.01)
*F25D 21/12* (2006.01)

(52) U.S. Cl.
CPC ..... *F25D 21/12* (2013.01); *F25D 21/002* (2013.01)

(58) Field of Classification Search
CPC ..... F25B 2500/27; F25B 2600/0251; F25B 2600/23; F25B 2700/11; F25D 21/08; F25D 21/002
See application file for complete search history.

(56) References Cited

U.S. PATENT DOCUMENTS

| | | | | |
|---|---|---|---|---|
| 4,338,790 | A | 7/1982 | Saunders et al. | |
| 4,439,995 | A | 4/1984 | McCarty | |
| 5,528,908 | A * | 6/1996 | Bahel | F25B 13/00 62/81 |
| 5,931,009 | A | 8/1999 | Choi | |
| 6,609,388 | B1 * | 8/2003 | Hanson | B60H 1/321 62/151 |
| 6,631,620 | B2 * | 10/2003 | Gray | F25D 21/002 62/155 |
| 9,970,700 | B2 * | 5/2018 | Cho | F25D 21/006 |
| 2015/0184924 | A1 * | 7/2015 | Vie | F25D 21/004 62/80 |
| 2018/0290519 | A1 * | 10/2018 | Son | B60H 1/3211 |

OTHER PUBLICATIONS

FDA—Are You Storing Food Safely (Year: 2018).*

* cited by examiner

*Primary Examiner* — Frantz F Jules
*Assistant Examiner* — Lionel Nouketcha
(74) *Attorney, Agent, or Firm* — Dority & Manning, P.A.

(57) ABSTRACT

A method for defrosting an evaporator of a sealed system includes determining that a defrost cycle is needed to remove frost from the evaporator and initiating such a defrost cycle. The method further includes determining that the defrost cycle failed to defrost the evaporator and repeating the defrost cycle until the defrost cycle is successful or until a predetermined number of defrost cycles have been performed. After a predetermined number of successive failed defrost cycles, the method includes preventing further operation of the sealed system, e.g., by locking out compressor, until the frost and/or ice build-up is removed.

20 Claims, 4 Drawing Sheets

METHOD FOR DEFROSTING AN EVAPORATOR OF A SEALED SYSTEM

FIELD OF THE INVENTION

The present subject matter relates generally to heat pumps, such as heat pumps for packaged terminal air conditioner units, heat pump water heaters, or split heat pump systems.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. Generally, one-unit type air conditioner units include an indoor portion and an outdoor portion. The indoor portion is generally located indoors, and the outdoor portion is generally located outdoors. Accordingly, the air conditioner unit generally extends through a wall, window, etc. of the structure.

One problem frequently encountered with modern air conditioner units and other heat pump systems is accurately determining when to defrost the evaporator. For example, when the evaporator is active, frost can accumulate on the evaporator and thereby reduce efficiency of the evaporator. In particular, ice can build up and accumulate on the evaporator over time, and the ice can eventually block air flow through and around the evaporator. However, conventional defrost control schemes and algorithms may fail to remove all frost or ice build-up from the evaporator. In such cases, the compressor may return to normal operation in heat pump mode, resulting in potential sealed system deformation, leakage, and additional frost formation. Alternatively, the defrost cycle may be continuously repeated even when ineffective.

Accordingly, a method for operating heat pump using an improved defrost cycle would be useful. More specifically, a defrost cycle which determines when a defrost cycle fails to remove ice and/or frost from an evaporator and initiates remedial action would be particularly beneficial.

BRIEF DESCRIPTION OF THE INVENTION

Aspects and advantages of the invention will be set forth in part in the following description, or may be apparent from the description, or may be learned through practice of the invention.

In a first exemplary embodiment, a method for defrosting an evaporator of a sealed system is provided. The method includes determining that a defrost cycle is needed to remove frost from the evaporator and initiating the defrost cycle in response to determining that the defrost cycle is needed. The method further includes determining that the defrost cycle failed to defrost the evaporator and repeating the defrost cycle until the defrost cycle is successful or until a predetermined number of defrost cycles have been performed. The method also includes preventing further operation of the sealed system if the predetermined number of defrost cycles have been performed unsuccessfully.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
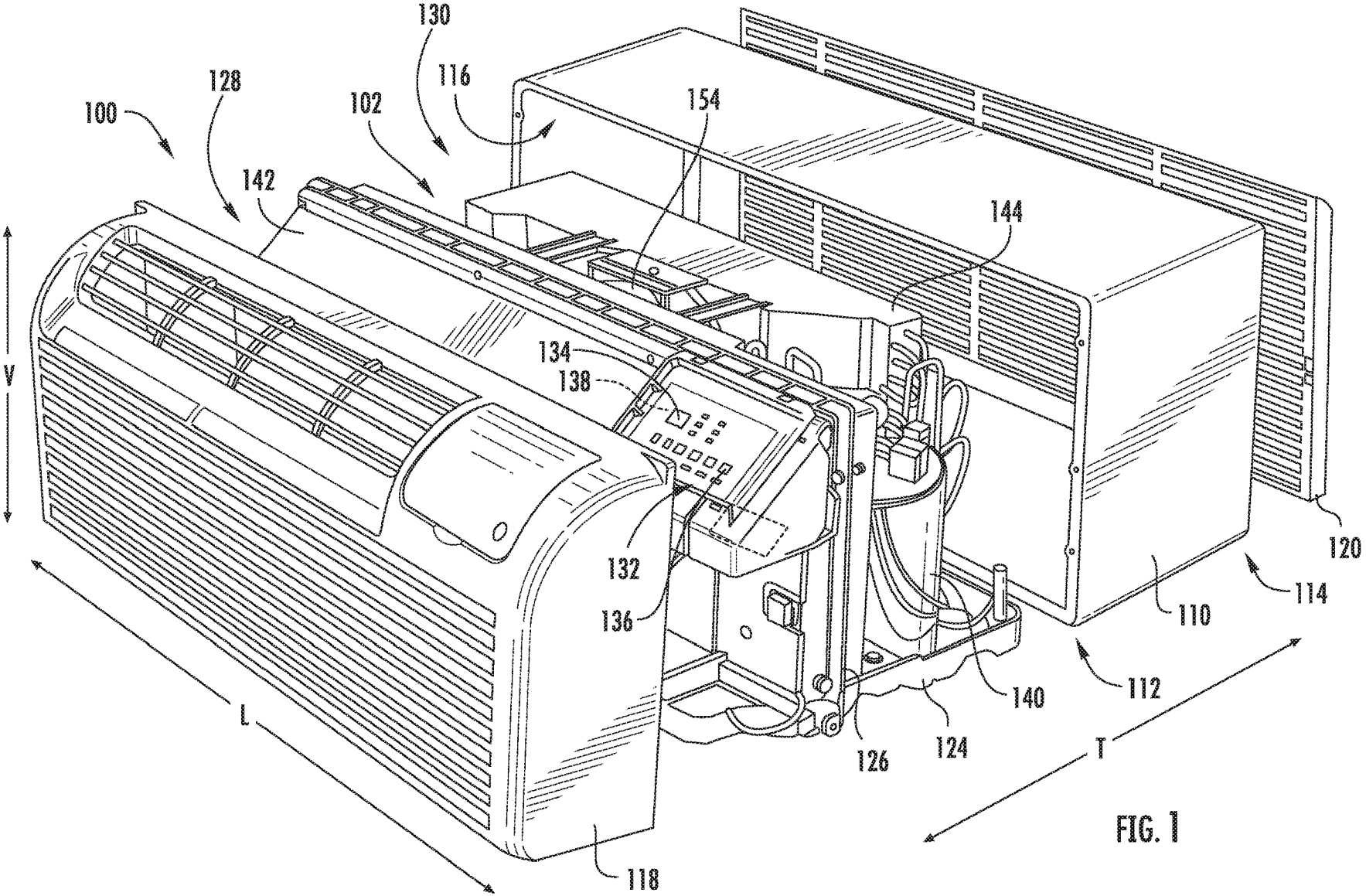
FIG. 1 provides an exploded perspective view of a packaged terminal air conditioner unit according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to example embodiments of the present disclosure. Generally, packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 102 (i.e., sealed heat exchange system) of packaged terminal air conditioner unit 100 is disposed within a wall sleeve 110. Thus, packaged terminal air conditioner unit 100 may be a self-contained or autonomous system for heating and/or cooling air. Packaged terminal air conditioner unit 100 defines a vertical direction V, a lateral direction L, and a transverse direction T that are mutually perpendicular and form an orthogonal direction system.

As used herein, the term "packaged terminal air conditioner unit" is used broadly. For example, packaged terminal air conditioner unit 100 may include a supplementary electric heater (not shown) for assisting with heating air within the associated room or building without operating the sealed system 102. However, as discussed in greater detail below, packaged terminal air conditioner unit 100 may also include a heat pump heating mode that utilizes sealed system 102, e.g., in combination with an electric resistance heater, to heat air within the associated room or building. Indeed, aspects of the present subject matter may have applications involving sealed systems in any air conditioner unit or in other appliances using sealed systems, such as refrigeration appliances.

As may be seen in FIG. 1, wall sleeve 110 extends between an interior side portion 112 and an exterior side portion 114. Interior side portion 112 of wall sleeve 110 and exterior side portion 114 of wall sleeve 110 are spaced apart from each other. Thus, interior side portion 112 of wall sleeve 110 may be positioned at or contiguous with an interior atmosphere, and exterior side portion 114 of wall sleeve 110 may be positioned at or contiguous with an exterior atmosphere. Sealed system 102 includes components for transferring heat between the exterior atmosphere and the interior atmosphere, as discussed in greater detail below.

Wall sleeve 110 defines a mechanical compartment 116. Sealed system 102 is disposed or positioned within mechanical compartment 116 of wall sleeve 110. A front panel 118 and a rear grill or screen 120 hinder or limit access to mechanical compartment 116 of wall sleeve 110. Front panel 118 is positioned at or adjacent interior side portion 112 of wall sleeve 110, and rear screen 120 is mounted to wall sleeve 110 at exterior side portion 114 of wall sleeve 110. Front panel 118 and rear screen 120 each define a plurality of holes that permit air to flow through front panel 118 and rear screen 120, with the holes sized for preventing foreign objects from passing through front panel 118 and rear screen 120 into mechanical compartment 116 of wall sleeve 110.

Packaged terminal air conditioner unit 100 also includes a drain pan or bottom tray 124 and an inner wall or bulkhead 126 positioned within mechanical compartment 116 of wall sleeve 110. Sealed system 102 is positioned on bottom tray 124. Thus, liquid runoff from sealed system 102 may flow into and collect within bottom tray 124. Bulkhead 126 may be mounted to bottom tray 124 and extend upwardly from bottom tray 124 to a top wall of wall sleeve 110. Bulkhead 126 limits or prevents air flow between interior side portion 112 of wall sleeve 110 and exterior side portion 114 of wall sleeve 110 within mechanical compartment 116 of wall sleeve 110. Thus, bulkhead 126 may divide mechanical compartment 116 of wall sleeve 110. Specifically, bulkhead 126 may generally separate and define an indoor portion 128 and an outdoor portion 130.

Referring again to FIG. 1, packaged terminal air conditioner unit 100 may additionally include a control panel 132 and one or more user inputs 134, which may be included in control panel 132. A display 136 may additionally be provided in the control panel 132, such as a touchscreen or other text-readable display screen. Alternatively, display 136 may simply be a light that can be activated and deactivated as required to provide an indication of, for example, an event or setting for the unit 100. The user inputs 134 and/or display 136 may be in communication with the controller 138. A user of packaged terminal air conditioner unit 100 may interact with the user inputs 134 to operate packaged terminal air conditioner unit 100, and user commands may be transmitted between the user inputs 134 and controller 138 to facilitate operation of packaged terminal air conditioner unit 100 based on such user commands.

Controller 138 may regulate operation of packaged terminal air conditioner unit 100, e.g., responsive to sensed conditions and user input from control panel 132. Thus, controller 138 is operably coupled to various components of packaged terminal air conditioner unit 100, such as control panel 132, components of sealed system 102, and/or a temperature sensor (not shown), such as a thermistor or thermocouple, for measuring the temperature of the interior atmosphere. In particular, controller 138 may selectively activate sealed system 102 in order to chill or heat air within sealed system 102, e.g., in response to temperature measurements from the temperature sensor.

In some embodiments, controller 138 includes memory and one or more processing devices. For instance, the processing devices may be microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 138 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
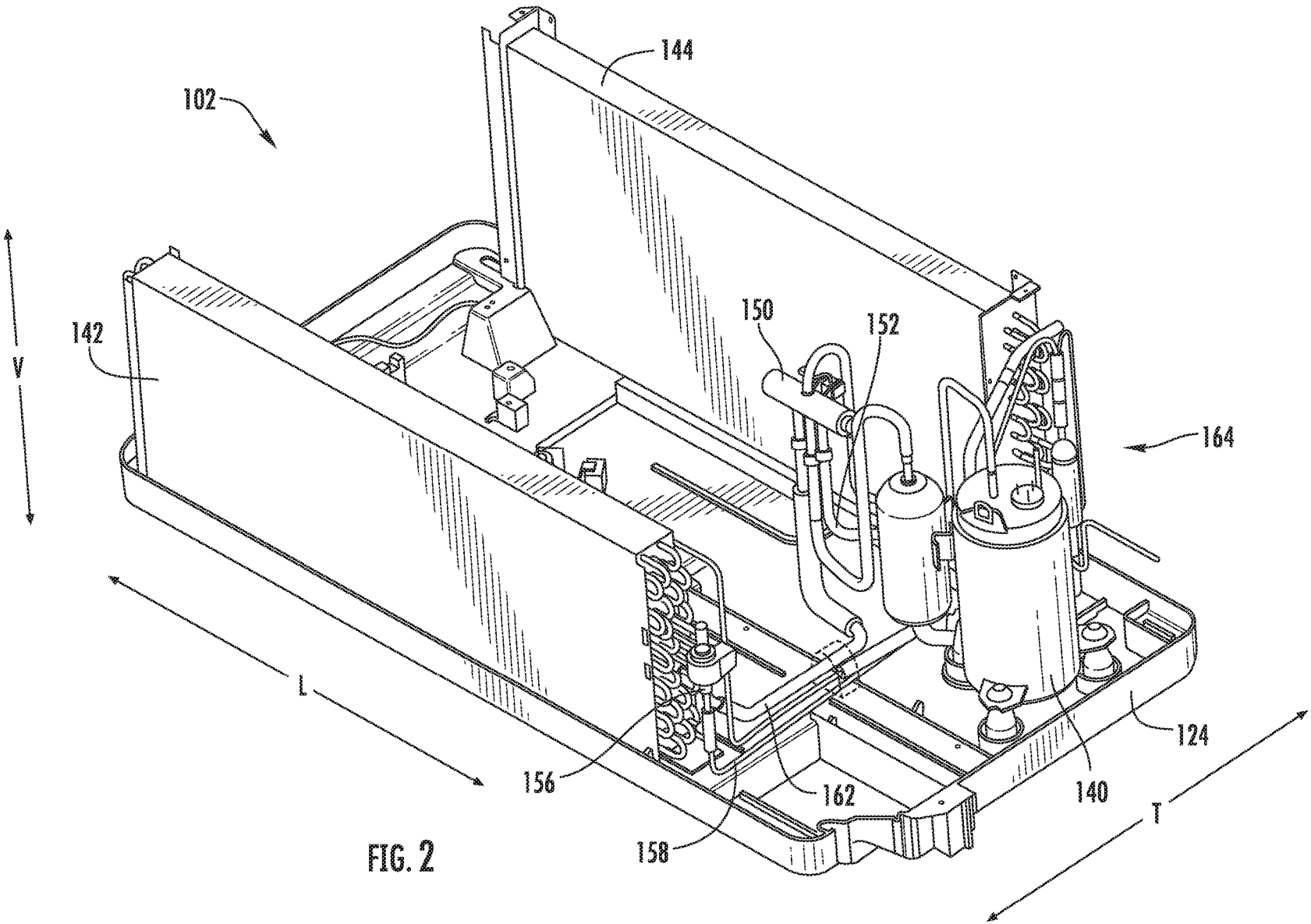
FIG. 2 provides a perspective view of certain components of the example packaged terminal air conditioner unit of FIG. 1.
Figure 3:
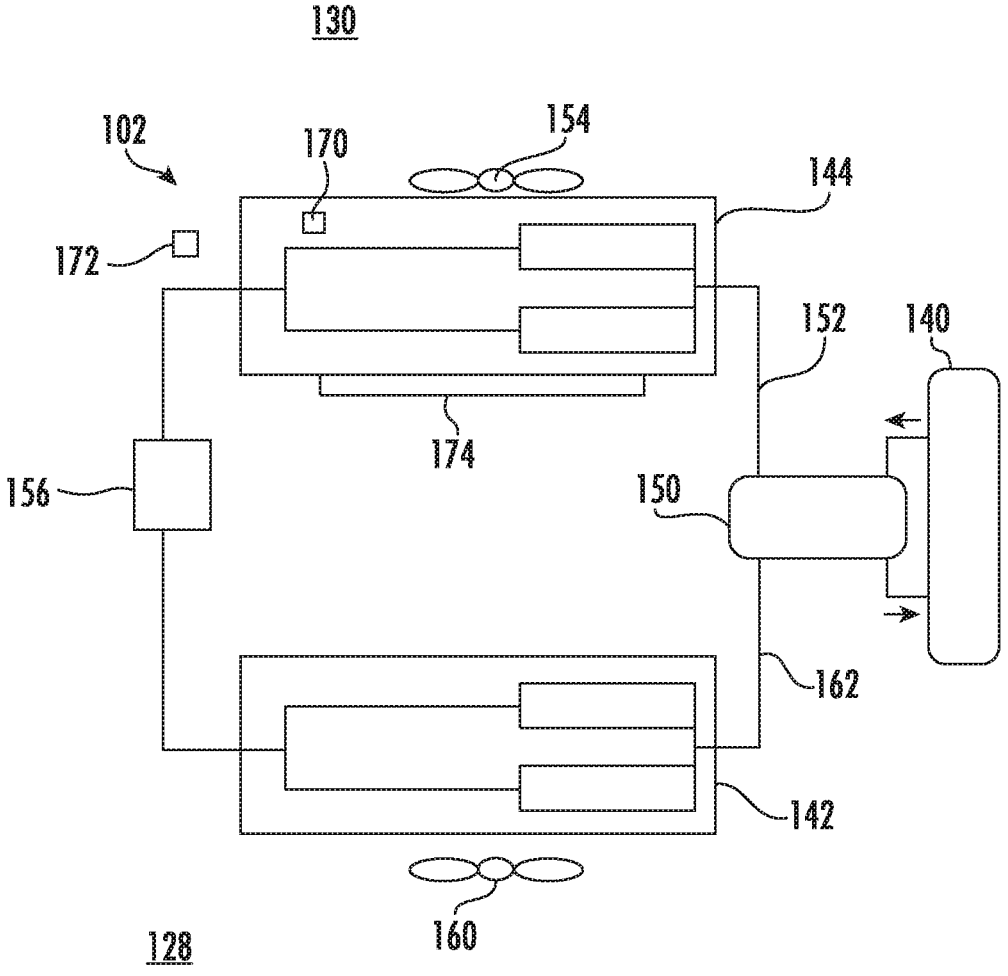
FIG. 3 provides a schematic view of certain components of the example packaged terminal air conditioner unit of FIG. 1.

FIG. 2 provides a perspective view of certain components of packaged terminal air conditioner unit 100, including sealed system 102. In addition, FIG. 3 provides a schematic view of packaged terminal air conditioner unit 100. As shown, sealed system 102 includes a compressor 140, an interior heat exchanger or coil 142 and an exterior heat exchanger or coil 144. As is generally understood, compressor 140 is generally operable to circulate or urge a flow of refrigerant through sealed system 102, which may include various conduits which may be utilized to flow refrigerant between the various components of sealed system 102. Thus, interior coil 142 and exterior coil 144 may be between and in fluid communication with each other and compressor 140.

As will be described in further detail below, sealed system 102 may operate in a cooling mode and, alternately, a heating mode. Thus, as may be seen in FIGS. 2 and 3, sealed system 102 may also include a compression reversing valve 150. Reversing valve 150 selectively directs compressed refrigerant from compressor 140 to either interior coil 142 or exterior coil 144. For example, in a cooling mode, reversing valve 150 is arranged or configured to direct compressed refrigerant from compressor 140 to exterior coil 144. Conversely, in a heating mode, reversing valve 150 is arranged or configured to direct compressed refrigerant from compressor 140 to interior coil 142. Thus, reversing valve 150 permits sealed system 102 to adjust between the heating mode and the cooling mode, as will be understood by those skilled in the art.

During operation of sealed system 102 in the cooling mode, refrigerant flows from interior coil 142 and to compressor 140. For example, refrigerant may exit interior coil 142 as a fluid in the form of a superheated vapor. Upon exiting interior coil 142, the refrigerant may enter compressor 140, which is operable to compress the refrigerant. Accordingly, the pressure and temperature of the refrigerant may be increased in compressor 140 such that the refrigerant becomes a more superheated vapor.

Exterior coil 144 is disposed downstream of compressor 140 in the cooling mode and acts as a condenser. Thus, exterior coil 144 is operable to reject heat into the exterior atmosphere at exterior side portion 114 of wall sleeve 110 when sealed system 102 is operating in the cooling mode. For example, the superheated vapor from compressor 140 may enter exterior coil 144 via a first distribution conduit 152 (FIG. 2) that extends between and fluidly connects compression reversing valve 150 and exterior coil 144. Within exterior coil 144, the refrigerant from compressor 140 transfers energy to the exterior atmosphere and condenses into a saturated liquid and/or liquid vapor mixture. An exterior air handler or outdoor fan 154 (FIG. 3) is positioned adjacent exterior coil 144 and may facilitate or urge a flow of air from the exterior atmosphere across exterior coil 144 in order to facilitate heat transfer.

According to the illustrated embodiment, an expansion device or a variable electronic expansion valve 156 may be further provided to regulate refrigerant expansion. Specifically, variable electronic expansion valve 156 is disposed along a fluid conduit 158 that extends between interior coil 142 and exterior coil 144. During use, variable electronic expansion valve 156 may generally expand the refrigerant, lowering the pressure and temperature thereof. In the cooling mode, refrigerant, which may be in the form of high liquid quality/saturated liquid vapor mixture, may exit exterior coil 144 and travel through variable electronic expansion valve 156 before flowing through interior coil 142. In the heating mode, refrigerant, may exit interior coil 142 and travel through variable electronic expansion valve 156 before flowing to exterior coil 144. Variable electronic expansion valve 156 is generally configured to be adjustable, e.g., such that the flow of refrigerant (e.g., volumetric flow rate in milliliters per second) through variable electronic expansion valve 156 may be selectively varied or adjusted.

Interior coil 142 is disposed downstream of variable electronic expansion valve 156 in the cooling mode and acts as an evaporator. Thus, interior coil 142 is operable to heat refrigerant within interior coil 142 with energy from the interior atmosphere at interior side portion 112 of wall sleeve 110 when sealed system 102 is operating in the cooling mode. For example, the liquid or liquid vapor mixture refrigerant from variable electronic expansion valve 156 may enter interior coil 142 via fluid conduit 158. Within interior coil 142, the refrigerant from variable electronic expansion valve 156 receives energy from the interior atmosphere and vaporizes into superheated vapor and/or high quality vapor mixture. An interior air handler or indoor fan 160 (FIG. 3) is positioned adjacent interior coil 142 and may facilitate or urge a flow of air from the interior atmosphere across interior coil 142 in order to facilitate heat transfer. From interior coil 142, refrigerant may return to compressor 140 from compression reversing valve 150, e.g., via a second conduit 162 (FIG. 2) that extends between and fluidly connects interior coil 142 and compression reversing valve 150.

During operation of sealed system 102 in the heating mode, compression reversing valve 150 reverses the direction of refrigerant flow from compressor 140. Thus, in the heating mode, interior coil 142 is disposed downstream of compressor 140 and acts as a condenser, e.g., such that interior coil 142 is operable to reject heat into the interior atmosphere at interior side portion 112 of wall sleeve 110. In addition, exterior coil 144 is disposed downstream of variable electronic expansion valve 156 in the heating mode and acts as an evaporator, e.g., such that exterior coil 144 is operable to heat refrigerant within exterior coil 144 with energy from the exterior atmosphere at exterior side portion 114 of wall sleeve 110.

Referring specifically to FIG. 2, sealed system 102 may further include a line filter assembly 164 which is generally configured for removing or collecting contaminants from the flow of refrigerant, such as byproducts from brazing or other manufacturing processes, that may have accumulated within sealed system 102 (e.g., during assembly) and might otherwise damage moving elements (e.g., compressor 140) or restrict small orifices (e.g., at expansion device 156). As illustrated, line filter assembly 164 is positioned between and fluidly couples indoor heat exchanger 142 and outdoor heat exchanger 144. Line filter assembly 164 may include a filter media for collecting contaminants, a desiccant material, such as a zeolite molecular sieve, to remove undesired moisture that may be present in sealed system 102, etc. However, it should be appreciated that according to alternative embodiments, line filter assembly 164 may have any other suitable configuration and may be positioned at any other suitable location within sealed system 102.

It should be understood that sealed system 102 described above is provided by way of example only. In alternative exemplary embodiments, sealed system 102 may include any suitable components for heating and/or cooling air with a refrigerant. Similarly, sealed system 102 may have any suitable arrangement or configuration of components for heating and/or cooling air with a refrigerant in alternative exemplary embodiments.

FIG. 3 provides another schematic view of certain components of the packaged terminal air conditioner unit 100. As illustrated, packaged terminal air conditioner unit 100 may include one or more temperature sensors for measuring the temperature of various components or regions within unit 100. For example, an exterior coil temperature sensor 170 may be positioned at or adjacent exterior coil 144 and is configured for measuring a temperature of exterior coil 144 and/or refrigerant within exterior coil 144 (referred to herein, e.g., as exterior coil or evaporator temperature). In addition, an ambient temperature sensor 172 may be positioned outside unit 100 or within wall sleeve 110 away from exterior coil 144 for measuring the ambient external temperature.

As used herein, "temperature sensor" or the equivalent is intended to refer to any suitable type of temperature measuring system or device positioned at any suitable location for measuring the desired temperature. Thus, for example, each of exterior coil temperature sensor 170 and ambient temperature sensor 172 may be any suitable type of temperature sensor, such as a thermistor, a thermocouple, etc. In addition, temperature sensors 170, 172 may be positioned at any suitable location and may output a signal, such as a voltage, to controller 138 that is proportional to and/or indicative of the temperature of exterior coil 144 or the ambient environment.

According to an exemplary embodiment, packaged terminal air conditioner unit 100 may further include one or more heaters for facilitating a defrost process. For example, an exterior coil heating element 174 (FIG. 3) may be positioned at or adjacent exterior coil 144 and is configured for heating exterior coil 144 and/or ice on exterior coil 144, e.g., during defrosting of exterior coil 144. Thus, controller 138 may be configured to selectively activate and deactivate exterior coil heating element 174, e.g., during a defrost cycle to melt ice and frost on exterior coil 144 to improve air flow through exterior coil 144 for heat exchange with ambient air about exterior coil 144. Exterior coil heating element 174 may be any suitable type of heating element, such as an electric resistance heating element.

Figure 4:
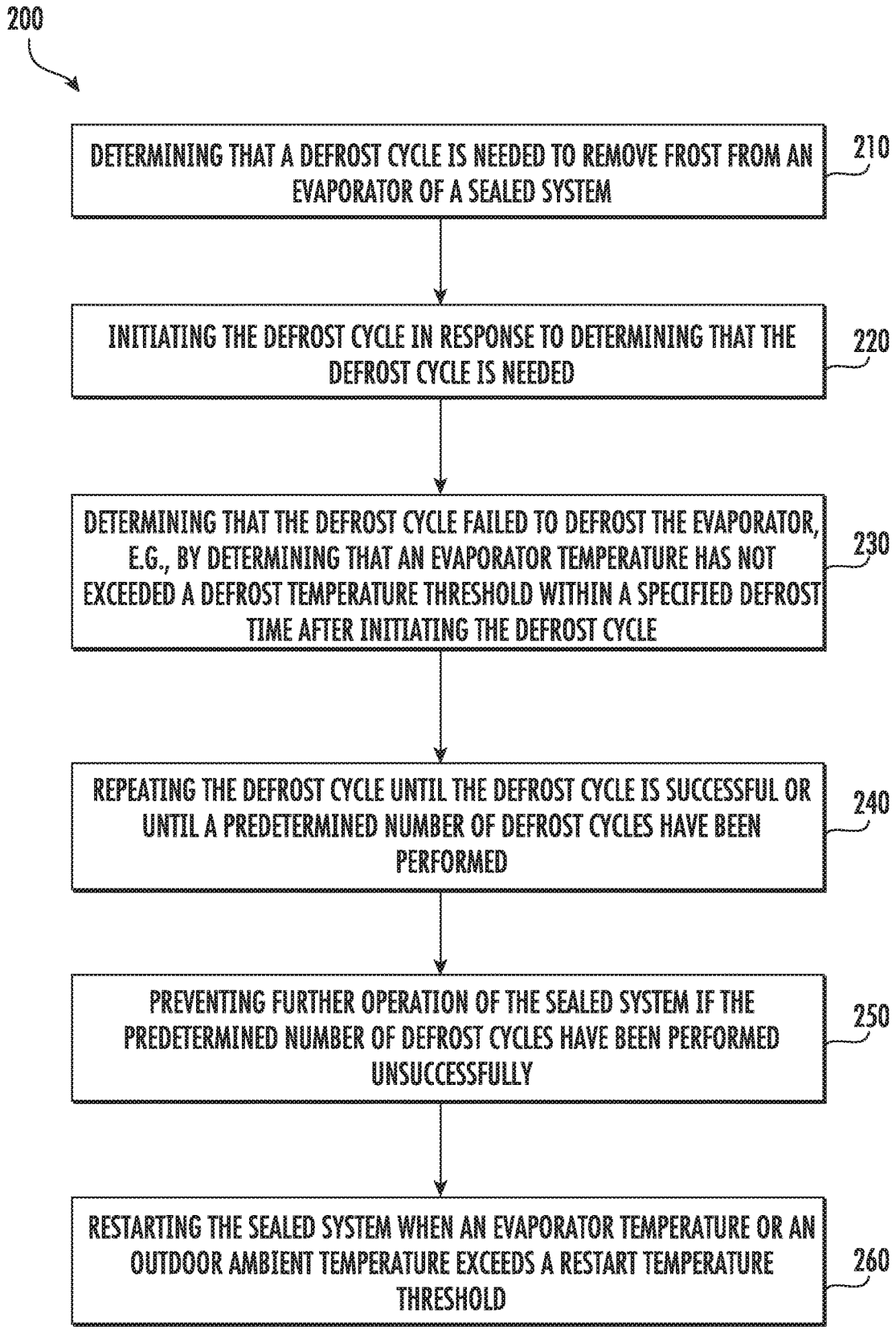
FIG. 4 illustrates a method for defrosting a heat pump according to an example embodiment of the present subject matter.

FIG. 4 illustrates a method 200 for defrosting an evaporator of a sealed system according to an example embodiment of the present subject matter. Method 200 may be used in or with any suitable heat pump or sealed system 102. For example, method 200 may be used with packaged terminal air conditioner unit 100, e.g., to regulate defrosting of exterior coil 144. Thus, method 200 is described in greater detail below in the context of packaged terminal air conditioner unit 100. However, it will be understood that method 200 may be used in or with heat pump water heater appliances, split heat pump systems, etc., in alternative example embodiments.

Method 200 includes, at step 210, determining that a defrost cycle is needed to remove frost from an evaporator of a sealed system. In addition, step 220 includes initiating the defrost cycle in response to determining that the defrost cycle is needed. For example, continuing the example from above, when sealed system 102 is operating as a heat pump, such that exterior coil 144 is operating as an evaporator, frost or ice may have a tendency to build up on exterior coil 144, resulting in decreased performance or even appliance damage. A defrost cycle is commonly used to melt and release frost and/or ice from the evaporator.

Although the terms "frost" and "ice" are used herein to describe the build up on the evaporator, it should be appreciated that these terms may be used to refer to any water or other liquid that freezes onto a coil, along with any particulates therein. In addition, the term "defrost cycle" may refer to any suitable actions taking by the air conditioner unit or sealed system in an attempt to remove frost and/or ice buildup. For example, according to one embodiment, the defrost cycle is performed by reversing the flow of refrigerant through sealed system 102, e.g., using compression reversing valve 150. In this manner, sealed system 102 operates in the cooling mode, thereby pumping high temperature refrigerant through exterior coil 144 and melting and releasing ice from exterior coil 144. In addition, according to certain exemplary embodiments, the defrost cycle may also include energizing a heating element, such as exterior coil heating element 174.

Notably, step 210 of determining that a defrost cycle is needed may be achieved in many suitable ways. For example, according to an exemplary embodiment, determining that a defrost cycle is needed may include determining that an outdoor ambient temperature (e.g., as measured by ambient temperature sensor 172) has remained below an ambient temperature threshold for a predetermined amount of time. Similarly, determining that the defrost cycle is needed may include determining that an evaporator temperature (e.g., as measured by exterior coil temperature sensor 170) has remained below and evaporator temperature threshold for a predetermined amount of time.

Notably, the ambient temperature threshold, the evaporator temperature threshold, and the predetermined amounts of time may be empirically determined, set by a manufacturer, adjusted by a user, or determined in any other suitable manner. For example, these values may be selected to correspond to conditions which typically result in a threshold amount of frost build-up on exterior coil 144. According to one exemplary embodiment, the predetermined amount of time may be a compressor run time limit. Specifically, the compressor run time refers to the time when the system (and thus compressor) is running, during which it is assumed that ice formation is occurring. Thus, if the ambient temperature, the evaporator temperature, or any other temperature providing a suitable indication of the amount of frost on exterior coil 144 stays below some threshold for an amount of time sufficient for the accumulation of frost and/or ice, controller 138 may initiate a defrost cycle to remove that ice.

Conventional packaged terminal air conditioner units have no means for determining whether a defrost cycle was successful at removing frost and/or ice buildup. Thus, conventional defrost cycles are typically open-ended cycles that operate for a fixed amount of time or operate until the evaporator reaches a fixed temperature. However, in the event there is an issue with the defrost process, time-based algorithms may incorrectly assume frost has been removed. By contrast, temperature-based algorithms may continue to operate in a defrost mode without successfully defrosting exterior coil 144. These algorithms provide no steps toward shutting down the system until remedial action may be taken. Steps 230 through 250 of method 200 are generally used to address these issues.

Step 230 includes determining that the defrost cycle failed to defrost the evaporator. For example, determining that the defrost cycle failed to defrost the evaporator may include determining that an evaporator temperature has not exceeded a temperature threshold (e.g., referred to herein as the defrost temperature threshold) within a specified defrost time after initiating the defrost cycle. For example, the defrost temperature threshold may be 40° F., 50° F., or greater. Similarly, the specified defrost time may be one minute, three minutes, five minutes, ten minutes, etc. According to exemplary embodiments, the defrost temperature threshold and the specified defrost time may be selected to correspond to a condition where the evaporator is still at least partially blocked by frost or ice. In other words, if a defrost cycles is successful, the evaporator temperature should rise above the defrost temperature threshold before some time has elapsed. If the evaporator temperature does not exceed that temperature within the time limit, controller 138 may assume that the defrost cycle has failed.

Notably, it may be desirable to reattempt the defrost cycle to dislodge any frost or ice build-up. Thus step 240 includes repeating the defrost cycle until the defrost cycle is successful or until a predetermined number of defrost cycles have been performed. It is desirable to place a limit on the number of successive defrost cycles to prevent wasted energy, to avoid causing other system wear or other issues, and to ensure the proper removal of any blockage, even if that requires technician intervention. Thus, for example, if controller 138 determines that a prior defrost cycle has failed, it may initiate a new defrost cycle if a defrost cycle counter is not exceeded the specified limit. For example, the predetermined number of defrost cycles may be three cycles, five cycles, 10 cycles, or any other suitable number of cycles.

It should be appreciated that as used herein, the defrost cycle counter may count only "successive" defrost cycles, which is intended to refer to the defrost cycles performed back to back without a long-term delay or continued system operation. However, it should also be noted that it may be desirable to provide a time delay between defrost cycles. For example, method 200 may include implementing a defrost time delay, e.g., around five minutes, between each successive defrost cycle.

Step 250 may further include preventing further operation of the sealed system if the predetermined number of defrost cycles have been performed unsuccessfully. Thus, continuing the example from above, if five successive defrost cycles have been performed and controller 138 still determines that the defrost cycles have failed, sealed system 102 may be prevented from operating in heat pump mode, in defrost mode, or in any other manner as desired. In this regard, preventing further operation of the sealed system may include turning off or powering down compressor 140, thereby stopping the flow of refrigerant and effectively shutting down unit 100.

After sealed system 102 has been shut off at step 250, step 260 may include restarting the sealed system when an evaporator temperature or an outdoor ambient temperature exceeds a restart temperature threshold. For example the restart temperature threshold may be a temperature at which all ice and/or frost would have melted from the exterior coil 144. For example, the restart temperature threshold may be about 42° F., though any other suitable temperature may be programmed by a user or the manufacturer of unit 100. Sealed system 102 may also continue normal operation if any one of the defrost cycles is deemed successful. In this regard, method 200 may include determining that an evaporator temperature has exceeded the defrost temperature threshold within the specified defrost time (e.g., indicating that the defrost cycle was successful), and thus continuing normal operation of sealed system 102.

FIG. 4 depicts an exemplary installation method and models having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using air conditioner unit 100 and sealed system 102 as an example, it should be appreciated that these methods may be used to defrost an evaporator in any other sealed system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for defrosting an evaporator of a sealed system, the method comprising:

determining that a defrost cycle is needed to remove frost from the evaporator;

initiating the defrost cycle in response to determining that the defrost cycle is needed;

stopping the defrost cycle;

determining, after the defrost cycle has been stopped, that the defrost cycle failed to defrost the evaporator;

repeating the defrost cycle until a predetermined number of defrost cycles have been performed; and preventing further operation of the sealed system if the predetermined number of defrost cycles have been performed unsuccessfully.

2. The method of claim 1, further comprising restarting the sealed system when a system temperature exceeds a restart temperature threshold that is selected to correspond to a condition where the evaporator is defrosted.

3. The method of claim 2, wherein the system temperature is an evaporator temperature.

4. The method of claim 2, wherein the restart temperature threshold is 42 degrees Fahrenheit.

5. The method of claim 2, wherein the system temperature is an outdoor ambient temperature.

6. The method of claim 1, wherein determining that the defrost cycle failed to defrost the evaporator comprises:

determining that an evaporator temperature has not exceeded a defrost temperature threshold within a specified defrost time after initiating the defrost cycle.

7. The method of claim 6, wherein the defrost temperature threshold is at least 50 degrees Fahrenheit and the specified defrost time is at least five minutes.

8. The method of claim 6, wherein the defrost temperature threshold and the specified defrost time are selected to correspond to a condition where the evaporator is still at least partially blocked by frost or ice.

9. The method of claim 1, wherein determining that the defrost cycle is needed comprises:

determining that an outdoor ambient temperature has remained below an ambient temperature threshold for a predetermined amount of time.

10. The method of claim 9, wherein the predetermined amount of time is a compressor run time limit.

11. The method of claim 1, wherein determining that the defrost cycle is needed comprises:

determining that an evaporator temperature has remained below an evaporator temperature threshold for a predetermined amount of time.

12. The method of claim 11, wherein the predetermined amount of time is a compressor run time limit.

13. The method of claim 1, wherein initiating the defrost cycle comprises:

operating the sealed system in a cooling mode to transfer heat from a condenser of the sealed system to the evaporator.

14. The method of claim 1, wherein initiating the defrost cycle comprises activating a heating element on the evaporator.

15. The method of claim 1, wherein preventing further operation of the sealed system comprises turning off a compressor.

16. The method of claim 1, wherein the predetermined number of defrost cycles is five cycles.

17. The method of claim 1, further comprising:

determining that an evaporator temperature has exceeded the defrost temperature threshold within a specified defrost time; and continuing normal operation and resetting a defrost cycle counter.

18. The method of claim 1, comprising:

implementing a defrost time delay between each successive defrost cycle.

19. The method of claim 18, wherein the defrost time delay is five minutes.

20. The method of claim 1, wherein the sealed system is positioned within a packaged terminal air conditioner.

* * * * *